United States Patent [19]

Makino et al.

[11] Patent Number: 4,671,494

[45] Date of Patent: Jun. 9, 1987

[54] EXCESSIVE LOAD PREVENTION APPARATUS EMPLOYABLE FOR A HOIST OR THE LIKE

[75] Inventors: Kazuhiro Makino, Kudamatu; Shigeo Numata, Hikari, both of Japan

[73] Assignee: Hitachi, Ltd., Tokyo, Japan

[21] Appl. No.: 712,771

[22] Filed: Mar. 18, 1985

[30] Foreign Application Priority Data

Mar. 23, 1984 [JP] Japan ..... 59-54220

[51] Int. Cl.[4] ..... B66D 1/58; B66D 5/32; F16D 63/00

[52] U.S. Cl. ..... 254/277; 188/65.3; 188/82.7; 188/82.77; 254/376

[58] Field of Search ..... 254/206, 207, 208, 209, 254/210, 211, 212, 223, 240, 247, 271, 272, 274, 277, 278, 310, 321, 356, 357, 375, 376; 74/501.5 R; 188/82.7, 82.74, 82.77, 65.3

[56] References Cited

U.S. PATENT DOCUMENTS

| | | | |
|---|---|---|---|
| 219,367 | 9/1879 | Schmitt | 254/272 X |
| 757,272 | 4/1904 | Conner | 254/240 |
| 884,776 | 4/1908 | Tanner | 254/206 |
| 1,174,280 | 3/1916 | Ragsdale | 254/240 |
| 2,136,596 | 11/1938 | Smith | 254/277 |
| 3,827,649 | 8/1974 | Payen | 188/82.7 X |
| 4,025,055 | 5/1977 | Strolenberg | 254/274 X |
| 4,542,883 | 9/1985 | Rutzki | 254/223 X |

FOREIGN PATENT DOCUMENTS

| | | | |
|---|---|---|---|
| 640670 | 7/1928 | France | 188/82.7 |
| 51878 | 9/1981 | Japan . | |
| 125597 | 1/1982 | Japan . | |
| 1538555 | 1/1979 | United Kingdom . | |
| 162644 | 12/1962 | U.S.S.R. | 254/376 |

*Primary Examiner*—Stuart S. Levy
*Assistant Examiner*—Joseph J. Hail, III
*Attorney, Agent, or Firm*—Antonelli, Terry & Wands

[57] ABSTRACT

An overload prevention apparatus includes a geared member with a number of teeth formed thereon, an engagement member including an engagement portion of which dimensions are determined so as to allow the latter to enter the valley on the geared member, a supporting member for turnably supporting the engagement member so as to allow the latter to turn toward and away from the geared member and a resilient member disposed between the engagement member and the supporting member to thrust the engagement portion on the engagement member toward the geared member. Either the geared member or the supporting member is arranged to move relative to the other. The direction of movement of the movable member is determined by the direction of extension of the teeth on the geared member. When hoisting ropes pull the movable member with excessively high force, the geared member is caused to move against thrusting force of the engagement member generated by the resilient member whereby the hoisting ropes are unreeled further. As a result, excessive energy can be successfully absorbed.

13 Claims, 12 Drawing Figures

EXCESSIVE LOAD PREVENTION APPARATUS EMPLOYABLE FOR A HOIST OR THE LIKE

BACKGROUND OF THE INVENTION

The present invention relates to an overload prevention apparatus preferably employable for a hoist or similar device mounted on crane or similar machine and, more particularly, to an apparatus for preventing an damage or distortion of a crane or similar machine which occurs when a heavier load than a rated load is hoisted.

If often happens with container cranes, that a platform or pallet which is being hoisted may snag the hatch of a vessel, so that the container is suddenly held back by the vessel, or similar malfunctions may occur. Once such trouble has occurred, the crane or a part of the vessel is likely to be damaged. To prevent this, a few proposals have already been made with respect to an overload prevention apparatus to be mounted on a crane to prevent damage deformation distortion to the crane.

Typical conventional overload prevention apparatuses disclosed in for example Japanese Patent Publication No. 51878/1983 (corresponding to GB 1538555 and DE-OS 2610267) and the force exerted on ropes by means of which a hoisting platform or the like is suspended from the hoist is detected directly or indirectly and, when it is found that a load heavier than the rated load is carried thereon, the hoisting is operation stopped.

In Japanese Patent Publication No. 51878/1983 another conventional apparatus is proposed wherein the ropes are resiliently supported while they are stretched radially by clamps and the supporting section is provided with a limit switch for detecting an overload by the displacement of the clamps.

In, for example, Japanese Patent Laid-Open No. 125597/1983, an excessive load prevention apparatus includes an current detector mounted on a motor for the hoist so as to detect an overload by the detected value of the current.

In the proposed overload prevention apparatus an overload is detected by a limit switch, a current detector or a similar instrument, the hoist motor is turned off and the brake is actuated. Although the hoist attempts to stop, it often happens that the drum continues to rotate due to inertia of the motor and the speed reduction mechanism, so that the hoist continues to lift the load. The larger the crane, the more likely this is to occur. With the conventional crane hoist, the crane must be halted frequently to prevent damage when an overload is detected. This is a critical problem when a pallet or the like means suddenly snags the rim of a hatch or some other obstruction during high-speed hoisting. Such accidents almost always damage the crane.

Thus, the present invention has been made with the foregoing background in mind and its object resides in providing an improved smaller, more reliable overload prevention apparatus which is not likely to excessively increase rope tension.

To accomplish the above object according to the present invention an apparatus for preventing an overload on a hoist or the like is proposed, wherein the apparatus includes a geared member including a number of teeth comprising valleys and peaks arranged alternately one after another, with an engagement member including an engagement portion dimensioned so as to allow the latter to enter the valley between the adjacent teeth on the geared member, and a supporting member for turnably supporting the engagement member so as to allow the latter to turn toward and away from the geared member. A resilient member is disposed between the engagement member and the supporting member to impel the engagement portion on the engagement member toward the geared member, with either the geared member or the supporting member being connectable to a hoisting platform or the like and the one member being arranged to move relative to the other in the direction of extension of the teeth. The engagement member and the teeth are arranged such that the engagement member is displaced away from the valley as the movable member is displaced.

Other objects, features and advantages of the present invention will become more clearly apparent from reading the following description which has been prepared in conjunction with the accompanying drawings.

BRIEF DESCRIPTION OF THE DRAWINGS

The accompanying drawings will be briefly described below.

DETAILED DESCRIPTION

The present invention will be described in greater detail hereunder with reference to the accompanying drawings which illustrate preferred embodiments thereof.

Figure 1:
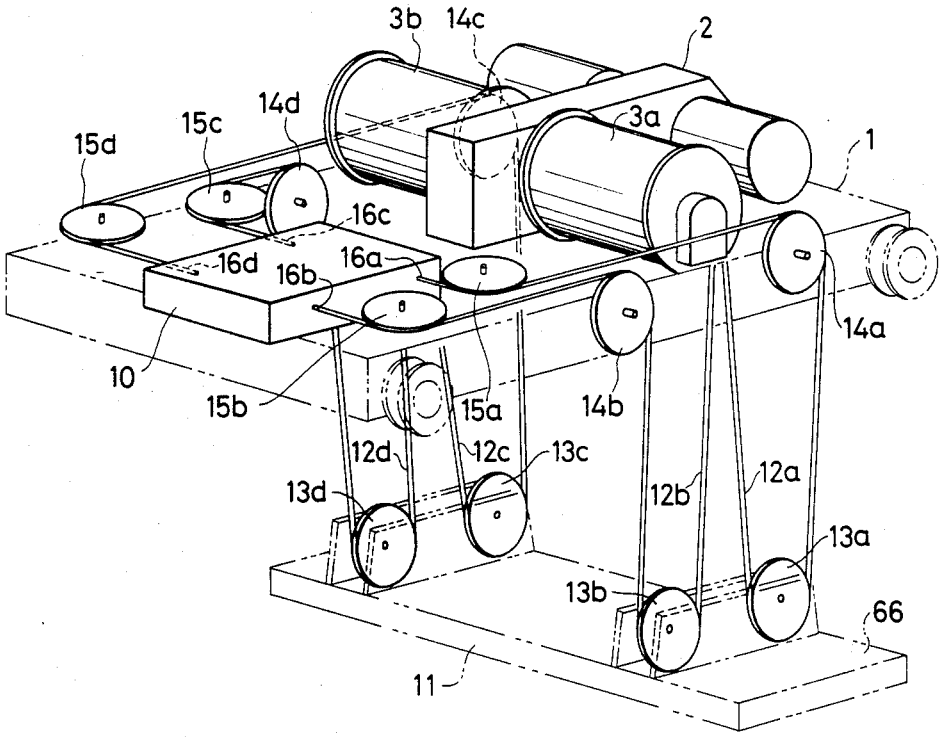
FIG. 1 is a schematic perspective view of the upper part of a crane, particularly illustrating how hoisting ropes are extended through an apparatus of the invention.

Referring now to the drawings wherein like reference numerals are used throughout the various views to designate like parts and, more particularly, to FIG. 1, according to this figure a trolley 1 is adapted to move on girder with a hoist 2 and an excessive load prevention apparatus 10 of the invention being mounted on the trolley 1. The hoist 2 includes two hoisting drums 3*a* and 3*b* around which four ropes 12*a*, 12*b*, 12*c* and 12*d* are wound with the ropes 12*a*, 12*b*, 12*c* and 12*d* being extended around sheeves 13*a*, 13*b*, 13*c* and 13*d* on a hoisting platform 11 and sheeves 14*a*, 14*b*, 14*c* and 14*d* on the trolley 1 until they reach and are anchored at the overload prevention apparatus 10. The fixed ends 16*a*, 16*b*, 16*c* and 16*d* of the overload prevention apparatus where the latter is fixed to the ropes 12*a*, 12*b*, 12*c* and 12*d* are located substantially flush with the sheaves 15*a*, 15*b*, 15*c* and 15*d*. As is apparent from FIG. 1, the ropes 12*a* and 12*b* on the right side of the hoisting platform 11 are fixed to the right side end of the excessive load prevention apparatus 10, whereas the ropes 12*c* and 12*d* on the left side of the same are fixed to the left side end of the same.

Figure 2:
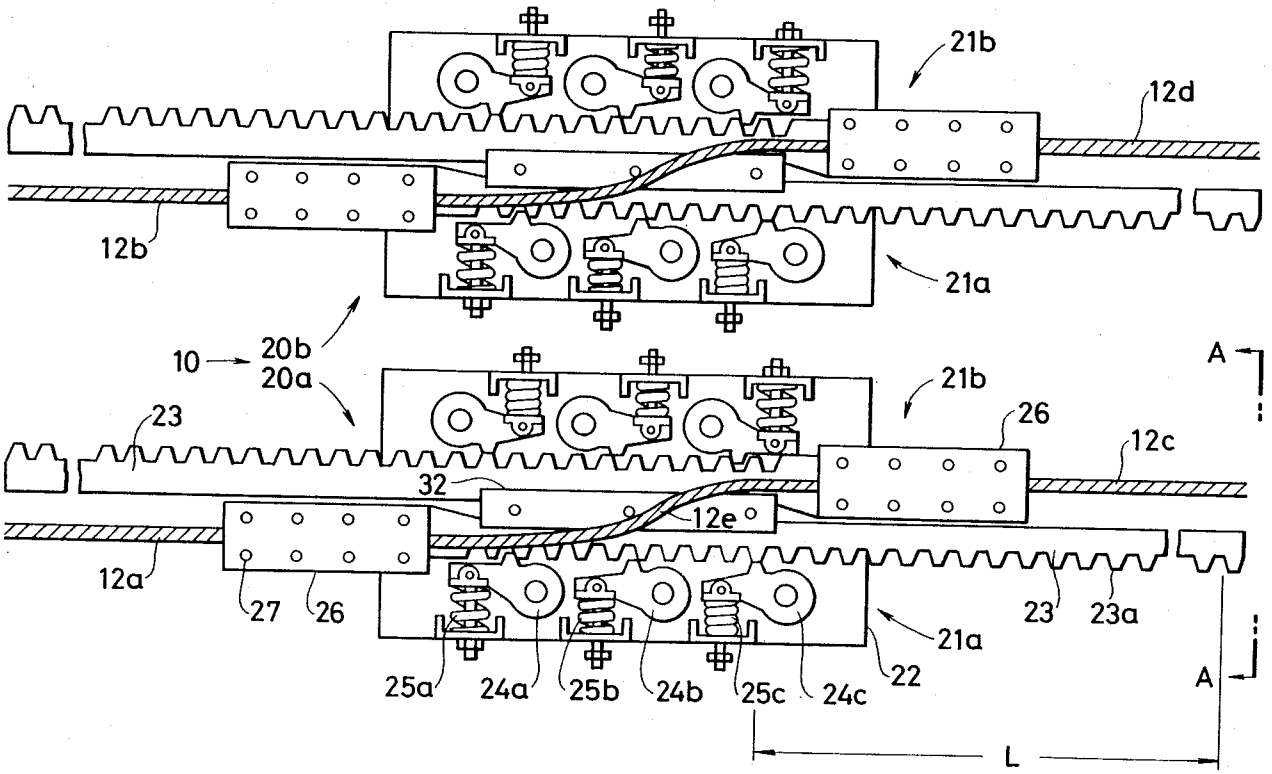
FIG. 2 is an enlarged plan view of the excessive load prevention apparatus according to an embodiment of the invention.

As shown in FIG. 2, the overload prevention apparatus includes a combination of two overload prevention sections 20*a* and 20*b* both of which are designed into the same structure, with one overload prevention section 20*a* having ropes 12*a* and 12*c* fixed thereto, and the other overload prevention section 20*b* having ropes 12*b* and 12*d* fixed thereto.

Further, each of the overload prevention sections 20*a* and 20*b* includes two overload preventive mechanisms 21*a* and 21*b* both of which are designed in the same structure but include racks adapted to move outward, that is, away from each other.

Figure 5:
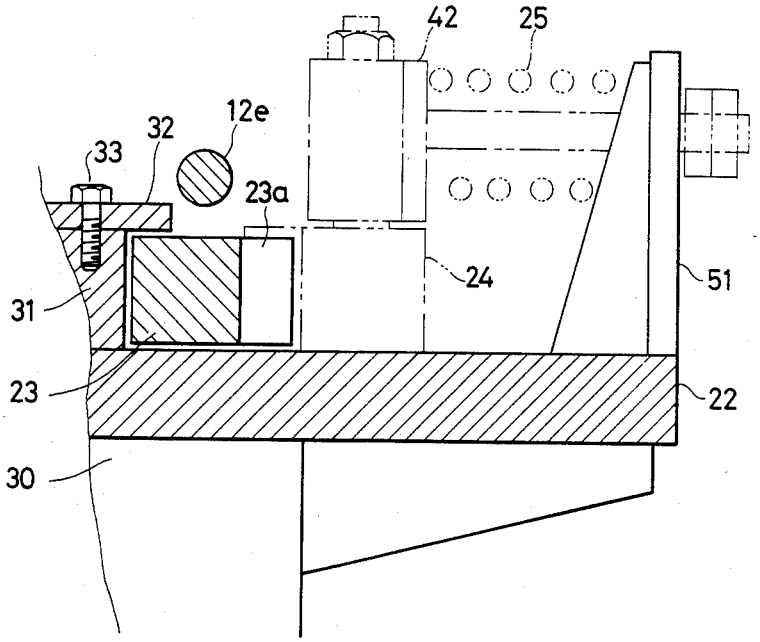
FIG. 5 is an enlarged cross-sectional view taken along the line B-C-D-E in FIG. 2.

To simply the description, an overload prevention mechanism 21 constituting the overload prevention section 20*a* will be typically described below with reference to FIGS. 4 to 6. Specifically, the excessive load prevention mechanism 21*a* comprises a rack 23, adapted to slide on a sliding seat 22 mounted on the trolley 1 by an anvil 30, a plurality of engagement members 24*a*, 24*b* and 24*c* adapted to be brought in meshing engagement with teeth 23*a* on the rack 23 and coil springs 25*a*, 25*b* and 25*c* to thrust the engagement members 24*a*, 24*b* and 24*c* toward the teeth 23*a* under the effect of resilient force of the coil springs 25*a*, 25*b* 25*c*. As is apparent from the drawing, the rope 12 is immovably held at the grip portion of the rack 23 by depressing it thereon by means of retaining plate 26 and bolts 27. Thus, there does not occur any slippage between the rope 12 and the grip portion.

The rack 23 is disposed in the horizontal direction. The racks 23 on both the overload prevention mechanisms 21*a* and 21*b* have teeth 23*a* which are oriented outwardly. Further, the grip side of the one rack 23 is located opposite to the non-grip side of the other rack 23.

A back seat 31 is fixedly attached to the central part on the upper side of the sliding seat 22 so that it comes in sliding contact with the racks 23, and an an upper seat 32 forms a sliding groove for the racks 23. The upper seat 32 is detachably secured to the back seat 31 by a plurality of bolts 33. Note that the engagement members 24*a*, 24*b* and 24*c*, the coil springs 25*a*, 25*b* and 25*c* and associated components to be described later are constructed in the same manner.

The engagement member 24 is adapted to slide on the sliding seat 22 turnably about the shaft 36 which is located at the one end thereof. Further, the sliding member 24 is fixedly mounted on the shaft 36 and the latter in turn extends through the sliding seat 22 so that it is fixedly secured to the rear surface. A member 37 serves to inhibit the bush 38 from being disconnected from the sliding seat 22. The engagement member 24 has an engagement piece 41 projecting upward from the left end of the engagement member 24 as seen in FIG. 4 so that the engagement piece 41 is brought in meshing engagement with the recess between the adjacent teeth 23*a* on the rack 23. Further, the engagement member 24 has a spring seat 42 at the extreme end located to the left of the engagement piece 41 to resiliently support the coil spring 25. The spring seat 42 is turnably mounted on the shaft 43 immovably secured to the engagement member 24 while a bush 44 is interposed between the engagement member 24 and the shaft 43 and liners 47, 46 are respectively interposed between the spring seat 42 and engagement member 24 as well as between the engagement member 24 and sliding seat 22. A member 45 prevents the bush 44 from being disconnected from the spring seat 42.

Figure 6:
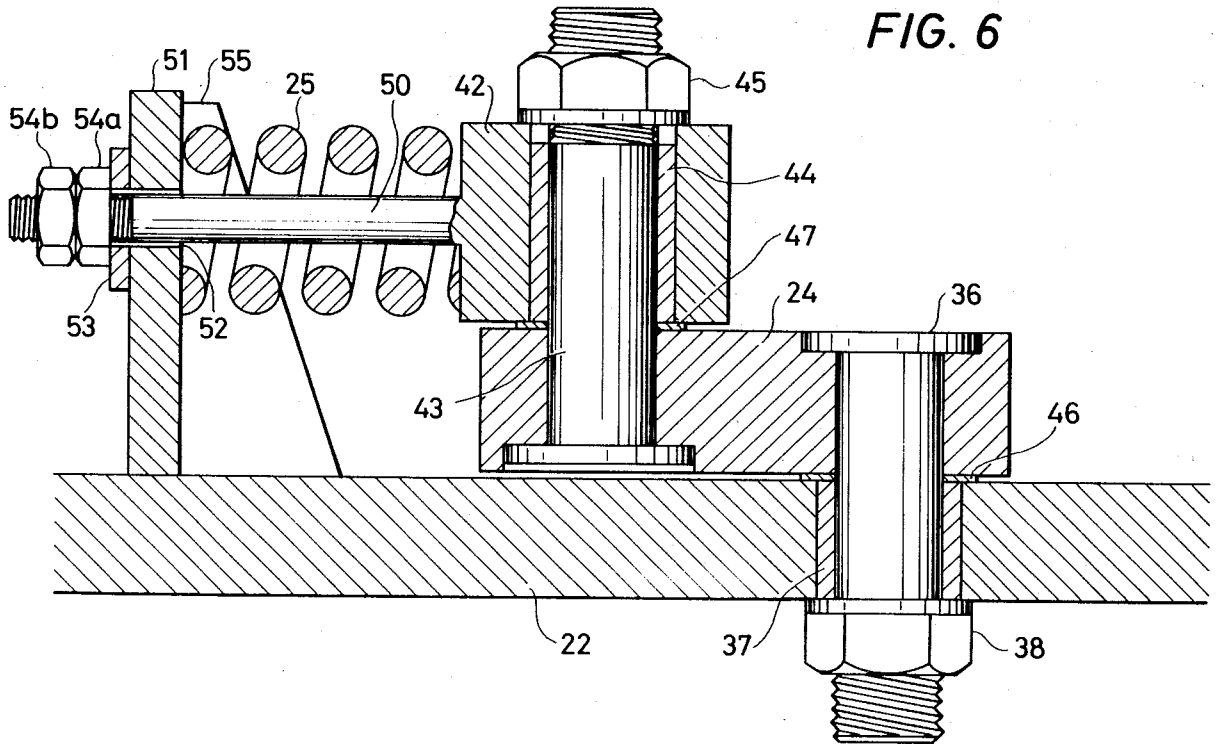
FIG. 6 is a partial sectional view of along line F-G-H in FIG. 4.

As is apparent from FIG. 6, the spring seat 42 has a threaded rod 50 made integral therewith, with the threaded rod 50 extending through a hole 52 of the bracket 51 attached to the sliding seat 22 and a washer 53 and nuts 54*a* and 54*b* are threadably mounted on the male threaded portion on the fore end part of the threaded rod 50. In the drawing, reference numeral 55 designates a stay.

The operative position of the engagement members 24*a*, 24*b* and 24*c*, that is, the positional relationship between the engagement pieces 41 of the engagement members 24*a*, 24*b* and 24*c* and the teeth 23*a* on the rack 23 is determined differently for each of the engagement members 24*a*, 24*b* and 24*c* relative to the associated teeth 23*a* as measured in terms of pitch between the adjacent teeth (as represented by the positional phase). Specifically, as illustrated in FIG. 4, the positional relationship of the engagement members 24*a*, 24*b* and 24*c* is determined in such a manner that the engagement piece 41 of the engagement member 24*a* is fully fitted into the valley between the adjacent teeth 23*a*, the engagement piece 41 of the engagement member 24*c* comes in contact with the top of the teeth 23*a* and the engagement member 24*b* assumes an intermediate position between the aforesaid operative positions of the engagement members 24*a* and 24*c*. As is readily apparent from the above description, the engagement members 24*a*, 24*b* and 24*c* are offset relative to the teeth 23*a* by a distance equal to one third of one pitch, while the teeth 23*a* are spaced equidistantly apart.

An access switch 60 detects a displacement of the rack 23, with an access switch 60 being provided for each of the racks 23. A responsive metal 61 is disposed opposite the access switch 60 and it is fixedly attached to the rack 23, and, when the access switch 60 detects displacement of the rack 23, the hoist 2 is stopped.

In practice, the rope 12*a* and the rope 12*c* are integrally connected to constitute a single rope and both the ends thereof are anchored at the drums 3*a* and 3*b*. As will be best seen in FIG. 3, both the ropes 12*a* and 12*c* have a slackened part 12*e* in the junction area as defined between the one retaining plate 26 and the other retaining plate 26. This is the same as in the case where the rope 12*b* is integrally connected to the rope 12*d*.

Figure 3:
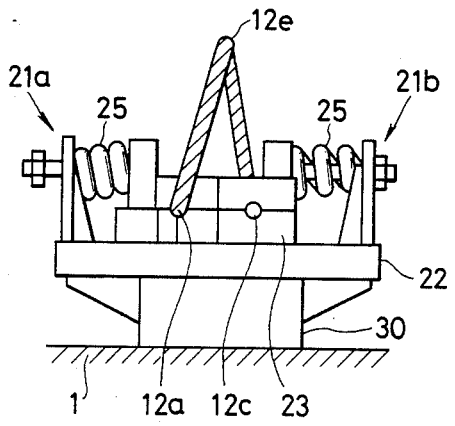
FIG. 3 is a front view taken in the direction of the arrows A—A in FIG. 2.

Note that the length L as measured from the position of the engagement piece 41 of the engagement member 24*c* to the right end of the rack 23 as seen in FIG. 3 is made longer than that required to absorb the kinetic energy of the hoisting operation when the rack 23 is displaced under the influence of excessive load. Further, an extent of slackening of the rope 12*e* in the junction area is determined so as to assure displacement of the rack 23 by a distance appreciably shorter than the length L.

The racks 23 are fixedly secured to the ropes 12*a* and 12*c* with a predetermined distance kept therebetween, the ropes 12*a* and 12*c* constituting a single rope. The predetermined distance is a dimension comprising the distance between both the retaining plates 26 and the length L as mentioned above while the racks 23 are assembled as illustrated in FIG. 2. With respect to orientation of the racks 23 reference should be made to FIG. 2.

Arrangement of the sliding seat 22 will now be described. As is best seen from FIG. 6, the engagement member 24 including the spring seat 42 made integral therewith is turnably mounted on the sliding seat 22 with the shaft 36. The spring seat 42 is equipped with a coil spring 25 in which the threaded rod 5 extends. Then, the threaded rod 50 extends through a hole 52 on the bracket 51 so that nuts 54*a* and 54*b* are threadably mounted on the male threaded portion of the threaded rod 50. By turning the nuts 54*a* and 54*b* the engagement member 24 is displaced downwardly as seen in FIG. 4 away from the rack 23 until the engagement piece 41 is disengaged from the rack 23. The above-mentioned steps are performed for all of the engagement members 24.

Next, the racks 23 with the ropes 12*a* and 12*c* fixedly secured thereto are placed on the sliding seat 22. At this time, it is important that the distance between the retaining plates 26 is reduced to the minimum and the engagement piece 41 of the engagement member 24 is set to a position where it is fully fitted into the valley between the adjacent teeth 23*a* on the racks 23. Next, the upper seat 32 is placed on the assembly of racks 23 and thereafter it is immovably held by bolts 33. The nuts 54*a* and 54*b* are then loosened until the engagement piece 41 comes in contact with the racks 23*a*. At this moment the distance as measured from the spring seat 42 to the nut 54*a* is set to a predetermined value. After the above-described adjustment clearance is created between the nut 54*a* and the bracket 51 with respect to both the engagement members 24*b* and 24*c*, as illustrated in FIG. 4.

It is evident that the overload prevention section 20*b* will be assembled in the same way as for the overload prevention section 20*a*.

Next, operation of the excessive load prevention apparatus as constructed in the above-described manner will be described below. While hoisting is normally performed with the hoisting platform 11 carrying container(s) thereon, four ropes 12 are kept in such an operative state as to pull four racks 23 which fail to be displaced with normal pulling force because the engagement piece 41 of the engagement member 24 comes in contact with the inclined face of the tooth 23*a*.

However, if a corner 66 of the hoisting platform 11 catches on a hatch, for example, when sheave 13*d* unexpectedly snags the hatch, excessive force is transmitted to the rack 23 on the overload preventive mechanism 21*a* by way of the rope 12*a*. In responsive to transmitting excessive force that way, the engagement member 24*a* is caused to turn away from the teeth 23*a*, that is, counter-clockwise as seen in FIG. 4, against resilient force of the coil spring 25*a* whereby the engagement piece 41 of the engagement member 24*a* is disengaged from the valley of the tooth. As a result, the rack is displaced to the left as seen in the drawing and the access switch 60 is then actuated so that the hoist 2 stops.

Figure 4:
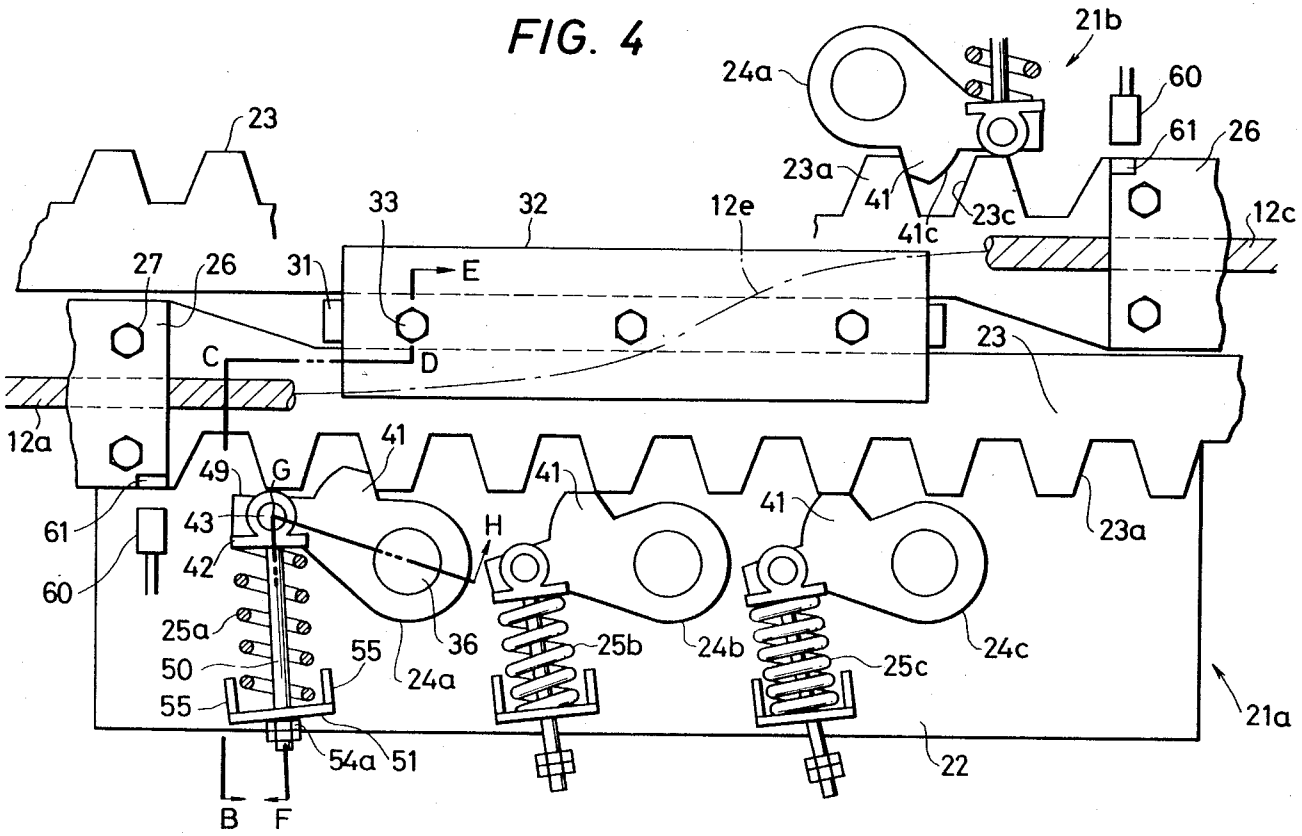
FIG. 4 is a partial enlarged plan view of the apparatus in FIG. 2.

Once the engagement piece 41 of the engagement member 24*a* has disengaged from the valley of the tooth 23*a*, the overload prevention mechanism 21*a* assumes the operative position as illustrated with respect to the engagement member 24*b* in FIG. 4. At this moment the engagement piece 41 of the engagement member 24*c* enters the valley between the adjacent teeth, while the engagement piece 41 of the engagement member 24*b* comes in sliding contact with the top of the tooth. This allows the engagement member 24*c* to prevent the rack 23 from being displaced further. Next, when the engagement member 24*c* disengages from the tooth due to an overload exerted on the rope 12*a*, the engagement piece 41 of the engagement member 24*b* in turn enters the valley whereby the engagement member 24*b* prevents further displacement of the rack 23 to the left as seen in the drawing. As the overload continues to be transmitted to the rack 23, the above-described steps of engaging the tooth and disengaging from the it are repeated in the order of the engaging members 24*a*, 24*b* and 24*c*.

To achieve displacement of the rack 23 a certain amount of energy is consumed to displace the engaging pieces 41 of the engaging members 24. When the total energy consumed for the foregoing operations becomes equal to an amount of kinetic energy consumed during hoisting operation, the hoist stops its hoisting operation.

When an excessive amount of kinetic energy is required for hoisting the rack 23 is displaced until the slackened part disappears and a stopper (not shown) disposed at the end of the rack 23 abuts against the sliding seat 22 and the rack 23 is stopped.

When a stopper such as mentioned above is not, provided, the other rack 23 is caused to move in the opposite direction to that of its normal displacement. In this case the other inclined face 23*c* of the tooth 23*a* on the rack 23 constituting the other overload prevention mechanism 21*b* abuts against the inclined face 41*c* of the engagement piece 41 with the result that the engagement member 24*a* of the other overload prevention mechanism 21*b* is caused to turn toward the teeth 23*a*. This causes the face 49, opposite the tooth 23*a* of the engagement member 24*a* to come in contact with the top of the tooth 23*a*. Accordingly, the rack 23 is prevented from displacement in the reverse direction.

A modification of the foregoing case where the face 49 comes in contact with the top of a tooth on the rack 23 to prevent reverse displacement of the rack 23, the threaded rod 50 extending from the shaft 43 to the nut 54*a* may be elongated to serve the same purpose. However, the preceding case has an advantageous feature in that the diameter of the threaded rod 50 is smaller.

As another modification, a stopper adapted to abut against the grip portion of the rack 23 may be provided at the position between the rack 23 and the sliding seat 22 to prevent displacement in the reverse direction.

When a container mounted on vessel is hoisted, all four racks 23 are actuated.

When the overload prevention apparatus of the invention is operated, the engagement members 24 are displaced to enter the valley between the adjacent teeth whereby re-engagement is established.

Owing to the arrangement of the racks in the horizontal direction as desribed above, the racks 23 are easy to position and assemble.

Next, the geometrical configuration of the teeth 23 and the engagement piece 41 of the engagement member 24 will be described with reference to FIG. 7.

A gear tooth 23*a* on the rack 23 is designed on the basis of a known rack.

An inclination angle $\theta_1$ of the engagement face 23*b* on the rooth 23*a* adapted to mesh with the engagement piece 41 is made smaller than an inclination angle $\theta_2$ of the back face 23*c*. The inclination angle $\theta_1$ is made smaller to assure that more energy is absorbed. The inclination angle $\theta_2$ is made larger so that the root area of the teeth 23*a* is stronger. For these reasons, the inclination angle $\theta_2$ of the back face is made larger than the inclination angle $\theta_1$ of the engagement face. Thus, the geometrical configuration of the invention is strong, rugged and capable of absorbing considerable energy.

Figure 7:
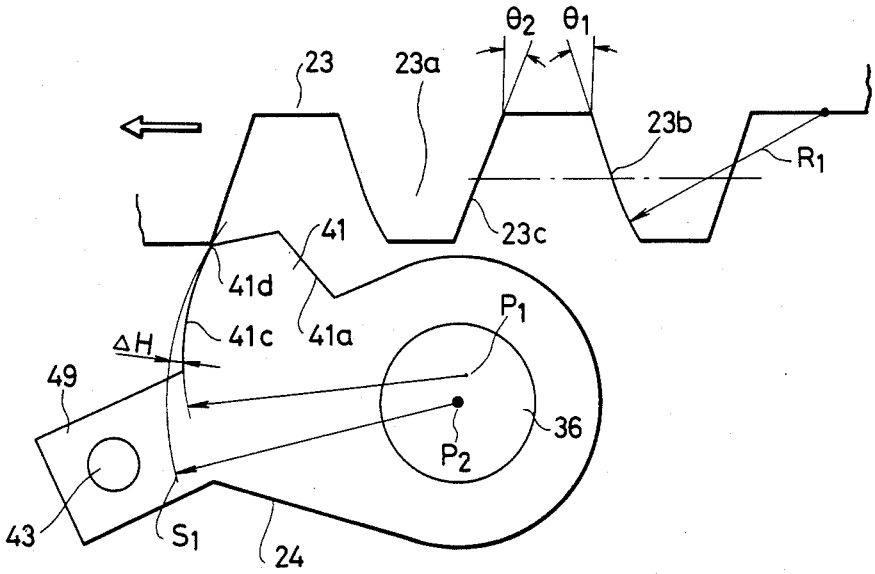
FIG. 7 is an enlarged plan view of an engagement member for the apparatus, particularly illustrating how the engagement member is operatively associated with a rack.

As is apparent from FIG. 7, the root of the engagement face 23*b* constituting the teeth 23*a* is designed in accordance with the partial circular arch which has a radius $R_1$.

Specifically, the root of the tooth 23*a* below the reference pitch line (as identified by the chain line) has a circular configuration as seen from the side. This makes it possible for the engagement face 41*a* of the engagement piece 41 to smoothly slide on the engagement face 23*b* of the tooth 23*a*.

The engagement piece 41 has a predetermined thickness as seen in the direction of movement of the rack 23. The working face 41*c* on the engagement piece 41 located on the front side as seen in the direction of movement has a circular configuration of which center point is represented by reference letter $P_1$. However, the center of rotation of the engagement member 24 is identical with the center $P_2$ of the shaft 36. Note that the track scribed by the outermost end 41*d* of the engagement piece 41 as the engagement member 24 is turned about the center $P_2$ is shown by the circular arc $S_1$. As shown in the drawing, the relief face 41*c* is offset inward from the circular arc $S_1$. Thus, reference letter $\Delta H$ represents the offset distance of the engagement piece 41 at the root area thereof.

Since the front working face 41*c* is designed in the retracted state, the engagement piece 41 can easily enter the valley on the rack 23 from the positional state as illustrated in FIG. 7. Specifically, when the rack 23 is displaced in the direction of the arrow for a short distance, the engagement piece 41 is immediately brought into the valley so that the engagement face 41*a* is immediately brought in contact with the engagement face 23*b*. If it is assumed that the relief face 41*c* on the root area of the engagement piece 41 is projected outward from the circular arc $S_1$, the engagement piece 41 cannot enter the valley unless the rack 23 is displaced at a distance greater than the distance of outward projection of the circular arc $S_1$. Hence, the critical point is on the circular arc $S_1$. The face 41*c* may be designed in a straight configuration without any loss in the above-mentioned characterizing feature.

Since the engagement piece 41 quickly comes in contact with the engagement face 23*c*, much energy can be absorbed.

The energy consumed by the overload prevention mechanism 21*a* below will now be described with reference to 8 FIGS. 8(A) to (D) which Figs. which show how energy consumed in the form of rope tension (tons) varies with displacement (cm) of the rack 23. In FIGS. 8(A)–8(D), energy consumed is represented by tension (tons) of rope 12*a* which displaces rope 23. Energy consumed corresponds to force required to hold the racks 23 on the sliding platform 22 with the aid of engagement members 24 and coil springs 25 to prevent the racks from being displaced further. In the drawings the aforesaid force is represented by tension of rope 12*a*.

Figure 8A:
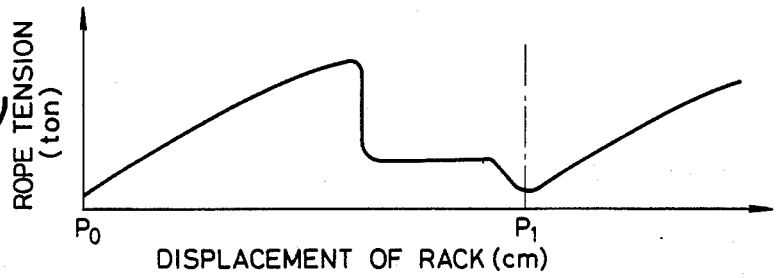
FIGS. 8(A) to 8(D) are a characteristic graphical illustration of characterizing features of the apparatus.

Referring to FIGS. 8(A) to 8(D) again, the engagement piece 41 and the teeth 23*a* are constructed in the same manner as described above. Specifically, FIG. 8(A) shows the relationship between displacement of the rack (cm) and rope tension (tons) with respect to the engagement member 24*a*, FIG. 8(B) does the same with respect to the engagement member 24*b*, FIG. 8(C) does the same with respect to the engagement member as does FIG. 8(D) for total rope tension (tons) relative to displacement of rack (cm) as measured with respect to the combination of FIGS. 8(A) to 8(C). FIG. 8(A) shows graphically that the rack 23 initiates its movement from the operational state where the engagement piece 41 is held in the valley of the rack 23, and while the aforesaid operational state is maintained, rope tensions increase as the rack 23 is displaced. When the engagement piece 41 is disengaged from the engagement face 23*b*, and it comes in contact with the top of the tooth, corresponding to the operative state of the engagement member 24*b* as illustrated in FIG. 4, rope tension decreases abruptly. While it comes in contact the the top, this operational state continues and when it enters the next valley, rope tension decreases further. In the drawings the distance as measured between $P_0$ and $P_1$ is identical to s length equal to one pitch, that is, one phase, of the teeth 23*a*.

Note that these drawings are based on results obtained by computer simulation. It has been found that experimental values obtained with a single engagement member 24 agree very closely with calculated values of simulations. The drawings have been prepared with reference to the results of simulations. In the drawings it is assumed that the engagement members are offset from one another by a distance equal to a phase dislocation of one third pitch within one phase as described above, while displacement speed of the racks is maintained constant.

Figure 8B:
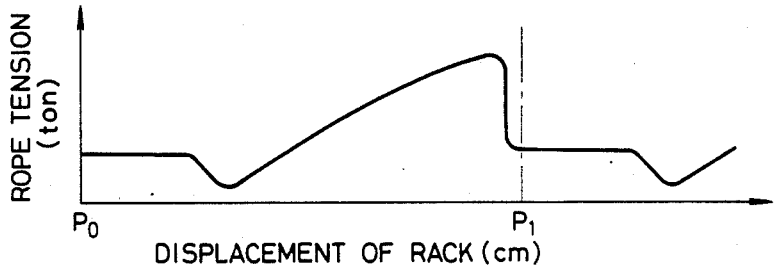
Figure 8C:
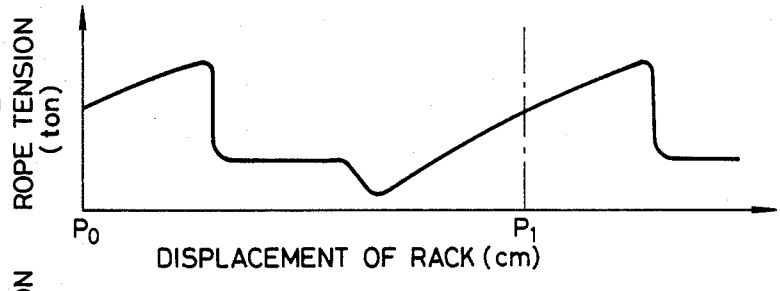
Figure 8D:
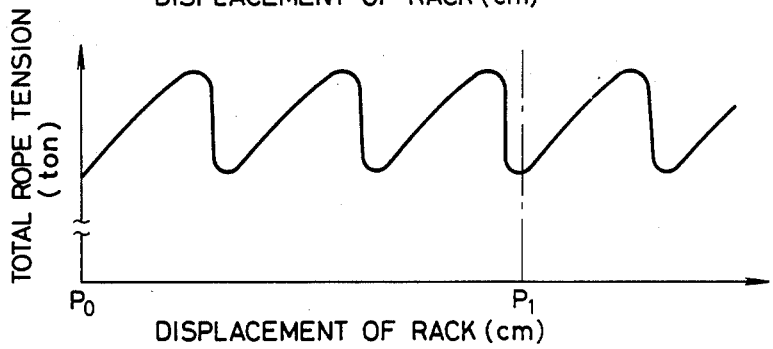

As will be readily apparent from FIGS. 8(A) to (C), each of the engagement members 24 consumes energy intermittently each time that the racks are repeatedly displaced. Obviously, the sum of repeated consumptions represents the total amount of energy consumed. The amount of energy consumed in the area defined by one pitch (one phase) of the one engagement member 24 is determined mainly by resilient force of the coil spring 25. Thus, it is possible to increase the volume of consumption of energy. Since the distance that the rack 23 is displaced until it stops can be shortened, the apparatus can be made smaller. Since energy is consumed by many actuations of the engagement members in that way, there is no need to maximize the amount of energy consumed by a single actuation of the engagement member 24. The arrangement of the apparatus which has just been described does not place excessively high tension on the rope 12 during operation of the hoist. This means that there is no need to enlarge the diameter of the rope 12.

Particularly due to the arrangement that a plurality of engagement members 24 are disposed in the equally spaced relation offset from one another relative to one pitch (one phase) of the rack 23, the amount of consumed energy continues to fluctuate periodically, as illustrated in FIG. 8 (D). When the apparatus is equipped with three engagement members 24, it continues to fluctuate in the manner shown. Therefore, the rope 12 is not made excessively taut. Further, the apparatus is operated smoothly. The total amount of consumed energy can be increased and thereby the apparatus can be made smaller. It is preferred that the number of engagement members 24 be determined by the geometrical configuration of the teeth 23 and that it be made as large as is feasible. Ideally, the number of engagement members 24 should be an integer multiple of three, with the members being spaced equidistant apart.

Note that energy consumption is not always totally dependent on friction. When it is the result of friction, the degree of friction varies with the state of the surface, for example, oily or dry. Even with this invention, friction varies with the surface state, that is, whether the back seat 31 and the teeth 23*a* are oily or dry; however, oiling these suurfaces has no effect on the intensity of force required to displace the coil spring 25. Due to the characterizing features described above, the present invention can provide an apparatus which operates very reliably. Further, the amount of energy consumed is easily calculated; hence, the apparatus can be easily designed.

Since the rotational shaft 36 of the engagement member 24 is to the rear of the engagement piece 41 relative to the turning movement of the engagement member 24 as seen in FIG. 7, the distance of turning movement of the engagement member 24 can be reduced whereby the coil springs 25 can be easily arranged, and the working stroke of the coil springs 25 can be shortened.

Since the coil springs 25 are disposed forward of the rotational shafts 36 as seen in the drawings, the apparatus can be made small.

As is apparent from the drawings, as one rack 23 contacts the back seat 31 driven by the coil springs 25, so does the other rack 23 contact the back seat 31 driven by the springs 25. Thus, both the racks 23 are kept in a well balanced state relative to the back seat 31. The latter can therefore be designed simply.

Two racks 23 are extended in parallel with one another whereby actuation of one rack immediately causes actuation of the other rack.

In the illustrated embodiment of the invention the thread rod 50 and the engagement member 24 are operatively connected to the shaft 43. Alternatively, modification may be made in any acceptable manner such that the spring retainer 42 serves to thrust the engagement member 24 toward the rack 23 driven by the coil spring 25. Typically, modification may be made such that the coil spring 25 is compressed by pulling the thread rod 50 toward the bracket 51 and thereby the spring retainer 22 disengages from the engagement member 24. In this case the engagement member 24 is manually caused to enter the valley on the rack.

In the above-described embodiment of the invention four racks are employed for ropes, with the number of racks being determined by the number of ropes. As can readily be appreciated, the ropes may be replaced by chains.

The resilient member for depressing the engagement mber may be a dish-shaped spring, or any other type of resilient member may be employed, provided that it is able to operatively engage the engaging piece with the associated valley on the rack when that piece is actuated.

Also, one engagement member may be formed with two engagement pieces in parallel with the direction of displacement of the rack.

Also, an engagement piece adapted to be operatively engaged with the associated tooth may be equipped with a plurality of rollers which are arranged along the contact surface thereof.

Alternatively, two racks 23 can be arranged in parallel so that their teeth project toward one another with engagement members interposed therebetween, while ropes are joined to one another with a slackened part 12*e* in the joined area.

Figure 9:
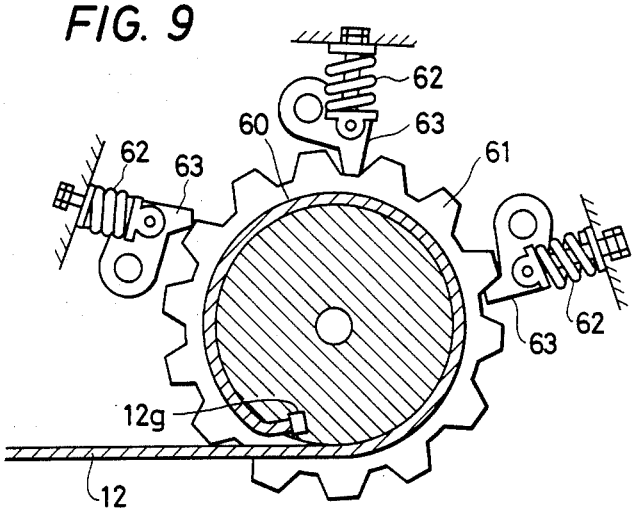
FIG. 9 is a cross-sectional view of an overload prevention apparatus according to another embodiment of the invention.

FIG. 9 shows a modified embodiment of the invention where racks are replaced with a gear. A rope 12 is wound about the sheave 60 and its one end 12*g* is anchored at the sheave 60. The gear 61 is fixedly secured to the sheave 60 in a coaxial relation. A plurality of engagement members 63 are adapted to contact the gear 61 impelled by springs 63. The springs 62 and the engagement members 63 are constructed in substantially the same manner as described above. Engagement members 63 should be arranged equidistant apart on the periphery of the gear 61.

According to the modified embodiment of the invention the effective length of the apparatus can be substantially reduced, compared with the foregoing embodiment. When more rope is needed, the sheave 60 may be a drum around which many turns of rope can be wound.

In each of the above-described embodiments of the invention, arrangement is made such that rack with teeth formed thereon serves as a moving member, and the engagement members and springs are stationary. However, the present invention is not be limited only to this configuration. Alternatively, arrangement may be made in the reverse way.

For instance, in case of the rack system as illustrated in FIG. 4, arrangement may be made such that racks are fixedly held but the sliding seat with engagement members and springs carried thereon is adapted to move relative to the racks, while ropes are joined to the sliding seat. The position where ropes are joined to the sliding seat may be determined such that rope 12*c* is joined to the right end of the overload prevention mechanism 21*a* and the rope 12*c* is joined to the left end of the overload prevention mechanism 21*b* as seen in FIG. 4.

With respect to the modified embodiment as illustrated in FIG. 9 where a gear system is employed, arrangement may be made in the reverse of the configuration described above. For example, a plurality of engagement members are arranged around the shaft of the drum with rope wound thereabout, whereas, an inner ring gear is immovably mounted in coaxial relation relative to the shaft of the drum at a position outward of the engagement members.

The positiion where the overload prevention apparatus of the invention is mounted may be determined in any acceptable manner in accordance with the position where ropes are connected or joined to one another with a slackened part therebetween, for instance, a girder, hoisting platform or the like.

Cranes are often equipped with an apparatus to control the longitudinal inclination of the hoisting platform traverse inclination or rotational movement of the same or the like operation. To minimize the space occupied by these apparatus, these controlling apparatus are additionally provided with the overload prevention apparatus of the invention.

It is evident from the above that the apparatus of the invention is constructed such that engagement members are brought in operative engagement with the teeth on racks under impelled by resilient force whereby much energy can be absorbed with a minimal working stroke and the apparatus operates reliably.

What is claimed is:

1. An apparatus for preventing overload on a hoist means, comprising:

a geared member including a number of teeth comprising valleys and hills arranged alternately one after another, an engagement member including an engagement portion dimensioned so as to allow the latter to enter the valley between the adjacent teeth on the geared member, a supporting member for turnably supporting the engagement member so as to allow the latter to turn toward and away from the geared member, a resilient member disposed between the engagement member and the supporting member to thrust the engagement portion on the engagement member toward the geared member, either said geared member or said supporting member being connectable to a hoisting platform means, one member being arranged to move relative to the other one in the direction of extension of the teeth, said engagement member and said teeth being arranged such that the engagement member is displaced away from the valley as the movable member is displaced, and wherein the center of turning movement of the engagement member relative to the supporting member is to a rear of the engagement part as viewed in the direction of relative movement of the geared member relative to the supporting member and the position where the resilient force of the resilient member is exerted on the engagement member is forward of the center of turning movement of the engagement member as viewed from the geared member.

2. An apparatus for preventing overload on a hoist means, comprising:

a geared member including a number of teeth comprising valleys and hills arranged alternately one after another, an engagement member including an engagement portion dimensioned so as to allow the latter to enter the valley between the adjacent teeth on the geared member, a supporting member for turnably supporting the engagement member so as to allow the latter to turn toward and away from the geared member, a resilient member disposed between the engagement member and the supporting member to thrust the engagement portion on the engagement member toward the geared member, either said geared member or said supporting member being connectable to a hoisting platform or the like means, one member being arranged to move relative to the other one in the direction of extension of the teeth, said engagement member and said teeth being arranged such that the engagement member is displaced away from the valley as the movable member is displaced and wherein a center of turning movement of the engagement member relative to the supporting member is to a rear of the engagement portion as viewed in the direction of relative movement of the geared member relative to the supporting member and a fore face of the engagement portion is to a rear of a track as scribed by an outermost end of the engagement portion as the engagement member is turned.

3. An apparatus for preventing overload on a hoist means, comprising:

a geared member including a number of teeth comprising valleys and hills arranged alternately one after another, an engagement member including an engagement portion dimensioned so as to allow the latter to enter the valley between the adjacent teeth on the geared member, a supporting member for turnably supporting the engagement member so as to allow the latter to turn toward and away from the geared member, a resilient member disposed between the engagement member and the supporting member to thrust the engagement portion on the engagement member toward the geared member, either said geared member or said supporting member being connectable to a hoisting platform or the like means, one member being arranged to move relative to the other one in the direction of extension of the teeth, said engagement member and said teeth being arranged such that the engagement member is displaced away from the valley as the movable member is displaced and wherein the geared member is designed in a straight configuration and the movable member is arranged to move linearly, with the geared member including two movable racks arranged in parallel on both sides of a back seat which is secured to a central part of the supporting member, each of said racks being formed with teeth along the outer side opposite to the back seat, and the engagement members and the resilient members are arranged in the area forward of the outer side of the rack so as to thrust the latter against the back seat.

4. An apparatus for preventing an overload on a hoist means, comprising:

a geared member including a number of teeth comprising valleys and hills arranged alternately one after another, an engagement member including an engagement portion dimensioned so as to allow the latter to enter the valley between the adjacent teeth on the geared member, a supporting member for turnably supporting the engagement member so as to allow the latter to turn toward and away from the geared member, a resilient member disposed between the engagement member and the supporting member to thrust the engagement portion on the engagement member toward the geared member, either said geared member or said supporting member being arranged to move relative to the other member and the direction of movement of the movable member being determined by the direction of extension of the teeth, said engaging member and said teeth being arranged such that the engagement member is disengaged from the valley as the movable member is displaced, and a member for joining the movable member to the hoisting platform so that the latter is suspended from the hoist, and wherein said gear member is designed in the form of a rack adapted to move and two racks are arranged in parallel such that they move in opposite directions, and wherein one half of a single rope is joined to a fore end of one rack, as viewed in a direction of the movement of the latter, and the other half of the same is joined to a rear end of the rack while a slackened part of the rope is prepared in an intermediate area between both ends of the racks.

5. An apparatus as defined in claim 4, wherein two racks are arranged on both the sides of the back seat mounted on the central part of the supporting member, each of said racks being formed with teeth which are oriented outwardly, and the engagement member and the resilient member are arranged in the area outward of each of the racks so as to thrust the rack toward the back seat, the direction of thrust of the engagement member toward the teeth being made to be horizontal.

6. An apparatus for preventing an overload on a hoist means, comprising:

a geared member including a number of teeth comprising valleys and hills arranged alternately one after another, a plurality of engagement members including an engagement portion dimensioned so as to allow the latter to enter the valley between the adjacent teeth of the geared member, a supporting member for turnably supporting the plurality of engagement members so as to allow each of the plurality of engagement members to turn toward and away from the geared member within a range of one phase of disposition of the teeth, a plurality of resilient members disposed between each of the engagement members and the supporting member to thrust the engagement portion of the engagement member toward the geared member, either said geared member or said supporting member being connectable to a hoisting platform means, the connectable member being arranged to be movable relative to the other member in a direction of extension of teeth by a tensile force from said hoisting platform means, and said engagement member and said teeth are arranged such that the engagement member is displaced with the engagement portion being away from one valley and re-entering the next valley as the movable member is displaced.

7. An apparatus as defined in claim 6, wherein said plurality of engagement means are equidistantly spaced apart.

8. An apparatus as defined in claim 6, wherein the number of said plurality of engagement members is equal to an integer multiple of three.

9. An apparatus as defined in claim 8, wherein said number of engagement members is arranged within the range of one phase of disposition of the teeth.

10. An apparatus as defined in claim 9, wherein among the plurality of engagement members arranged within the range of one phase of the first engagement member is at a position opposite to the associated tooth, the second one is at a position slightly offset from the associated teeth, and the succeeding members are offset successively further from the associated teeth.

11. An apparatus for preventing an overload on a hoist means, comprising:

two racks each of which includes a number of teeth comprising valleys and hills arranged alternately one after another with one end of dispostion of the teeth being connectable to a hoisting platform means, at least two engagement members each of which includes an engagement portion dimensioned so as to allow the latter to enter the valley between the adjacent teeth, a supporting member for turnably supporting each of the engagement members so as to allow the latter to turn toward and away from the rack, a back seat secured to the supporting member between the two racks in contact with each of said two racks, at least two resilient member disposed between each of the engagement members and the supporting member to thrust the engagement portion of the engagement member toward the racks, said two racks being arranged in parallel with each face side of the teeth of said racks placed outwardly and with each rack allowed to move in a direction of extension of the teeth by a tensile force from the hoisting platform means, and said two engagement members being arranged relative to each of said two racks with the engagement portion being away from one valley and re-entering the next valley as the racks are displaced.

12. An apparatus as defined in claim 11, wherein said two racks are arranged such that they move in opposite directions and are connected via a single rope slackened in a center part of said rope, one end of the rope being joined to a fore end of one rack in the direction of movement of said one rack and the other end of the rope being joined to a fore end of the other rack in a direction of movement of said other rack.

13. An apparatus as defined in claim 11, wherein said engagement members are arranged so as to allow a turning direction of said engagement members to be horizontal and to have said resilient member located upwardly of said engagements members as viewed from said the back seat secured to said supporting member between the two racks.

* * * * *